US007404439B2

(12) United States Patent
Schuh

(10) Patent No.: US 7,404,439 B2
(45) Date of Patent: Jul. 29, 2008

(54) HORIZONTAL DRILLING

(75) Inventor: Frank J. Schuh, Plano, TX (US)

(73) Assignee: Frank J. Schuh, Inc., Plano, TX (US)

( * ) Notice: Subject to any disclaimer, the term of this patent is extended or adjusted under 35 U.S.C. 154(b) by 170 days.

(21) Appl. No.: 11/484,261

(22) Filed: Jul. 11, 2006

(65) Prior Publication Data

US 2008/0011484 A1 Jan. 17, 2008

(51) Int. Cl.
*E21B 43/24* (2006.01)
*E21B 43/00* (2006.01)

(52) U.S. Cl. ..... 166/272.3; 166/372; 166/272.7

(58) Field of Classification Search ..... 166/272.3, 166/372, 272.7, 303, 370, 222, 223
See application file for complete search history.

(56) References Cited

U.S. PATENT DOCUMENTS 4,397,612 A * 8/1983 Kalina ..... 417/54
4,640,355 A * 2/1987 Hong et al. ..... 166/269
4,787,450 A * 11/1988 Andersen et al. ..... 166/267
5,016,709 A * 5/1991 Combe et al. ..... 166/245
5,215,149 A * 6/1993 Lu ..... 166/303
5,289,881 A * 3/1994 Schuh ..... 166/303
5,607,018 A * 3/1997 Schuh ..... 166/303
5,782,261 A * 7/1998 Becker et al. ..... 137/155
5,826,655 A * 10/1998 Snow et al. ..... 166/272.3
5,931,230 A * 8/1999 Lesage et al. ..... 166/303
6,073,696 A * 6/2000 Ellis ..... 166/312
6,708,763 B2 * 3/2004 Howard et al. ..... 166/303
2002/0096332 A1 * 7/2002 De Almeida ..... 166/319
2003/0159828 A1 * 8/2003 Howard et al. ..... 166/372
2005/0150657 A1 * 7/2005 Howard et al. ..... 166/303
2006/0076145 A1 * 4/2006 Lembcke et al. ..... 166/372
2006/0213652 A1 * 9/2006 Shaposhnikov et al. ..... 166/68
2007/0107902 A1 * 5/2007 Jelsma ..... 166/313

* cited by examiner

*Primary Examiner*—Jennifer H Gay
*Assistant Examiner*—Cathleen R Hutchins
(74) *Attorney, Agent, or Firm*—F. Lindsey Scott

(57) ABSTRACT

A method and apparatus for recovering viscous hydrocarbons from a subsurface reservoir holding the same using an essentially horizontal well bore having a production inlet and containing steam injection tubing that carries a plurality of jet nozzles oriented to emit steam along said injection tubing towards said production inlet.

11 Claims, 3 Drawing Sheets

HORIZONTAL DRILLING

BACKGROUND OF THE INVENTION

1. Field of the Invention

This invention relates to the drilling, completion, and production of an essentially horizontal (hereafter "horizontal") well section into and along a subsurface, geological formation that contains heavy, viscous hydrocarbons, as disclosed in U.S. Pat. Nos. 5,289,881 and 5,607,018, both issued to Frank J. Schuh.

2. Description of the Prior Art

U.S. Pat. No. 5,289,881 discloses in its FIG. 1 a horizontally extending well bore and casing section which contains steam injection tubing (injection tubing) 32. This injection tubing is terminated at its far down stream end by a choke 22 through which all vaporous steam (steam) injected from the surface of the earth leaves the tubing and enters the well bore casing annulus 42 for injection, through casing perforations 18, into producing zone 14. Zone 14 contains the viscous hydrocarbons that are desired to be produced to and recovered at the earth's surface. U.S. Pat. No. 5,289,881 is hereby incorporated in its entirety by reference.

U.S. Pat. No. 5,607,018 discloses a related production scheme in its FIG. 9 except that steam leaves the interior of steam injection tubing 132 by way of a series of holes 133 in that tubing. Holes 133 allow steam to exit the tubing in a direction that is directly toward casing 116, i.e., a direction that is essentially perpendicular to the long axes of both the injection tubing and the casing (liner) 116. Put another way, the exiting steam from the injection tubing is pointed directly at the inner surface of the casing, and its perforations 118, for injection of that steam into the hydrocarbon bearing formation 114 to liquefy such hydrocarbons for ultimate production to and recovery at the earth's surface. It is also disclosed in this patent, column 12, that the horizontal portion of the well bore can deviate less than 90° or more than 90° from the essentially horizontal portion of the well bore. U.S. Pat. No. 5,607,018 is hereby incorporated in its entirety by reference.

For sake of clarity, the horizontal sections of the well bore, casing and injection tubing are all shown in both of the aforesaid patents to be essentially straight along their longitudinal axes. In reality, this is not always the case. In drilling the horizontal portion of a well bore, the driller uses a commercially available instrument known as a three axis accelerometer to direct the drilling of that horizontal section. The typical accuracy for this instrument ranges from ¼ to ½ degree and can cause the driller to unknowingly deviate from the desired path. If the drilling path for any of a number of well known reasons, e.g., subsurface heterogeneities, tends too far upward or downward while drilling in the formation, the driller makes adjustments either up or down to the drilling apparatus to get the drill bit back on the desired drilling path. As explained hereinafter in greater detail, these adjustments, which are made while drilling proceeds unchecked, can result in the horizontal section of the well bore having, at least in parts thereof, a sinusoidal shape along the longitudinal axis of the well bore. Any sinusoidal configuration of the well bore is, upon completion of the well, transferred to the casing and injection tubing contained in the horizontal section of that well bore.

Thus, in reality, there can be one or more low spots in the horizontal sections of the well bore, casing, and injection tubing which can be substantial. For example, it is not uncommon for a low spot to deviate from about one to about five feet lower in elevation than the adjacent high spot.

Produced fluids, as used herein, are primarily a combination of liquid water (largely condensed steam) and liquid hydrocarbons that have been mobilized by contact with the steam injected into the formation from the injection tubing by way of the casing perforations. Produced fluids can collect in the aforementioned low spots. Undesired pools of produced fluids in such low spots not only mean lost production of desired hydrocarbons to the earth's surface, but can adversely affect the hydrocarbon production operation, e.g., by impeding or otherwise altering in a deleterious way the flow of steam in the casing annulus that surrounds the injection tubing.

Accordingly, it is highly desirable to have a horizontal well bore production scheme that overcomes the ill effects of hydrocarbons collecting in casing low spots, and this invention does just that.

SUMMARY OF THE INVENTION

In accordance with this invention, there is provided a method and apparatus for rendering mobile a viscous hydrocarbon held in a subsurface geologic formation by employing a horizontal well bore completion scheme that includes a steam injection tubing string that contains a plurality of jet nozzles that inject vaporous steam along the injection tubing, and toward a production tubing inlet.

DETAILED DESCRIPTION OF THE INVENTION

Figure 1:
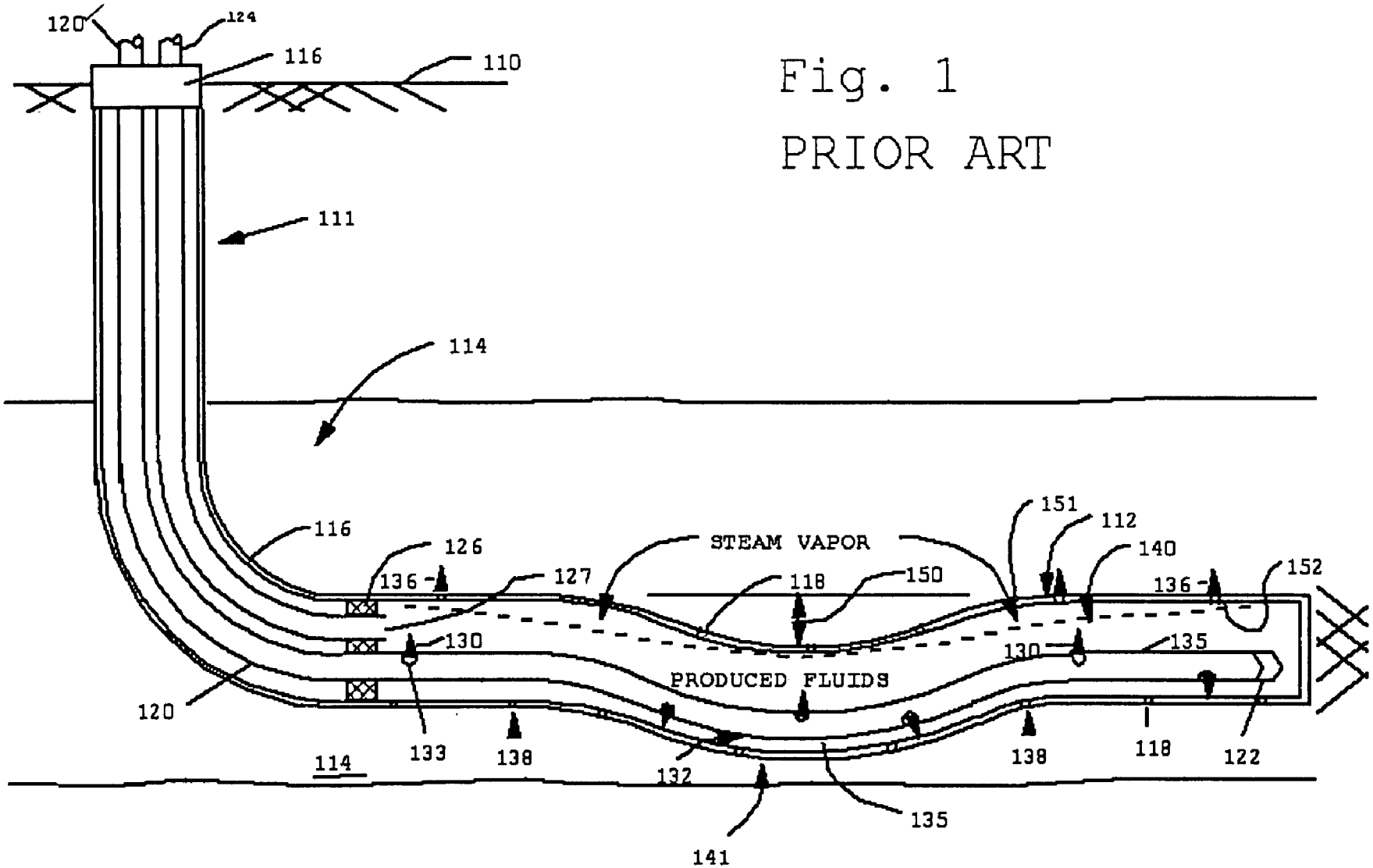
Fig. 1 PRIOR ART
FIG. 1 shows a cross section of a horizontal well completion pursuant to the prior art including an exemplary low spot in the well bore and its associated casing and injection tubing.

FIG. 1 shows earth's surface 110 into which has been drilled in a conventional manner an essentially vertical well bore 111 which has been turned essentially 90° from the vertical to form an essentially horizontal well bore section (interval) 112 in hydrocarbon containing formation (reservoir) 114. At the upstream end of horizontal section 112 of the well bore, a pack off 126 has been installed through which passes 1) steam injection tubing 120 whose horizontal section 132 contains a plurality of apertures (holes) 133 along its longitudinal axis (see FIG. 2), and 2) production tubing 124 with its associated production inlet 127. Production string inlet 127 receives produced fluids from horizontal section 112, and transmits them by way of production tubing 124 to earth's surface 110 for recovery and other processing as desired.

Steam injected from earth's surface 110 through injection tubing 120 leaves the interior of that tubing by way of both holes 133, as shown by arrows 130, and choke 122; and enters the annulus 135 inside casing 116, which annulus surrounds horizontal section 132 of injection tubing 120. Annulus 135 has a substantially larger internal volume than the internal volume of injection tubing 120, e.g., a volumetric ratio of annular volume to injection tubing volume of from about 3/1 to about 5/1. This steam then leaves the interior of casing 116 by way of certain of the apertures 118 that extend around the circumference of section 112 of casing 116, and enters the interior of formation 114, as shown by arrows 136. This forms a steam cavity in formation 114 from which some hydrocarbon has been recovered and in which fresh steam is motivating (liquefying) additional viscous hydrocarbon present in the walls of such steam cavity. Produced fluids enter annulus 135 by way of certain other apertures 118 as shown by arrows 138.

Line 140 in FIG. 1 denotes the interface between vaporous steam from holes 133 and liquid, produced fluids from certain apertures 118 as afore said, and further shows that a certain volume of produced fluids will be trapped in low spot 141 of this FIG. 1. Low spot 141 can contain a substantial volume of trapped produced fluids because it can extend for tens of feet in length and be from one to five feet lower in elevation 150 than its associated high spot 151. Holes 133 inject steam directly toward the interior surface 152 and holes 118 of casing 116, i.e., essentially perpendicular to the longitudinal axis of injection tubing 120, and are not effective in cleaning out produced fluids trapped in low area 141 of annulus 135 for recovery of same at the earth's surface. In a given well, horizontal section 112 can contain a plurality of such low spots, just one such spot 141 being shown in FIG. 1 for sake of brevity and clarity.

Figure 2:
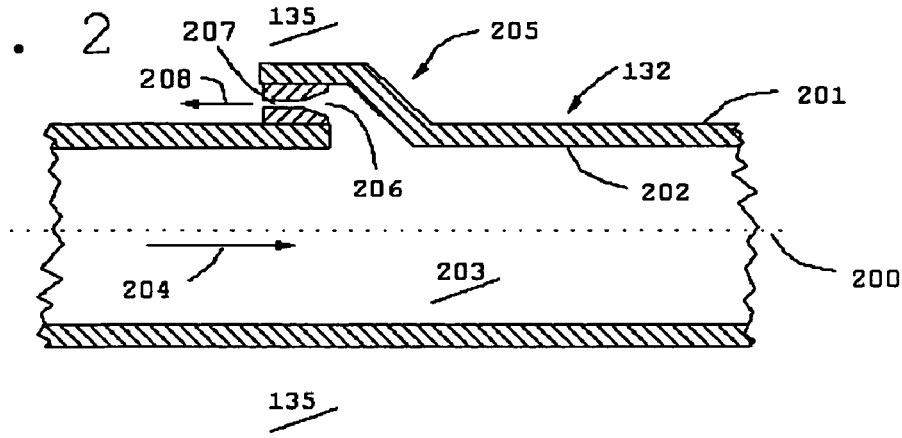
FIG. 2 shows a section of injection tubing employing a jet nozzle pursuant to this invention.

FIG. 2 shows a section of injection tubing 120 that employs a jet nozzle pursuant to this invention. Tubing 120 has an outer surface 201 and an inner surface 202. The longitudinal axis of tubing 120 is shown at 200. Steam from the earth's surface passes through interior 203 of tubing 120 in the direction shown by arrow 204. Steam 204 can be at a pressure of from about 250 to about 680 psia, and a temperature of from about 400 to about 500° F. Jet nozzle 205 is in fluid communication between injection tubing interior 203 and casing annulus 135. Outer surface 201 carries a jet nozzle 205 which contains a constriction 206 which accelerates the velocity of steam 204, and a narrower passage (choke) 207 which further accelerates the compressed, pressurized steam 208 into lower pressure, larger volume annulus 135, thus injecting steam 208 with substantial force into annulus 135. Such compressed steam 208 is also deliberately injected along the long axis 200, i.e., outer surface 201, of injection tubing 120 in a direction towards production inlet 127 (FIG. 1) to move both the produced fluids and steam toward the inlet for production to the earth's surface. This injection of compressed steam 208 into annulus 135 not only forcibly moves produced fluids towards production inlet 127, but at the same time removes essentially all trapped production fluids held in one or more low spots, e.g., area 141 of FIG. 1, that can occur from location to location along the length of injection tubing 120. Choke 207 can be, but is not necessarily, essentially round, and has a diameter of from about 7/32 to about 14/32 of an inch, or the equivalent if not round.

Figure 3:
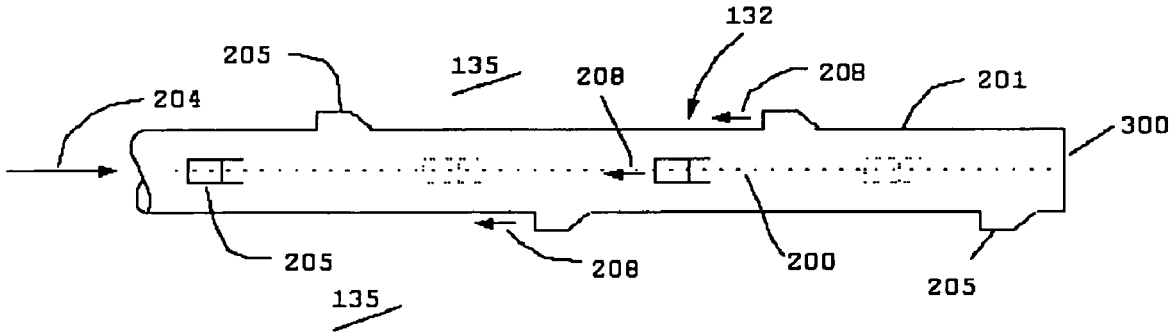
FIG. 3 shows a larger portion of the injection tubing of FIG. 2 which includes a number of variably positioned and spaced-apart jet nozzles, all within this invention.

FIG. 3 shows a longer section of injection tubing 120 containing a plurality of jet nozzles 205. Note that downstream end 300 is closed and does not contain a choke 122. Thus, choke 122 has been eliminated with out eliminating the function thereof. The injection of compressed steam 208 into annulus 135 is so robust that nozzles 205 can be spaced about the outer surface (periphery) 201 of tubing 120 in a random or patterned fashion and the results of this invention still realized. Thus, as shown in this Figure, nozzles 205 can be distributed on the top, bottom, and/or sides of tubing 120 as desired, or any individual choice or combination thereof.

By using a plurality of nozzles 205 that discharge steam essentially parallel to the long axis 200 of injection tubing 120, and toward the production inlet 127, sufficient flow-energy is generated to transport essentially all produced fluids, including any and all produced fluids trapped in low spots, to production inlet 127.

The amount of flow-energy generated, and the lift capacity of the nozzle array employed will vary considerably depending on the details of the particular well completion, and can be controlled by the steam injection rate at the earth's surface, the production rate of produced fluids at the earth's surface, and nozzle sizing, spacing, and positioning along the injection tubing, all of which can readily be determined by one skilled in the art once apprised of this invention. With close spaced nozzles, the available energy is greater than required to transport produced fluids, and the uniformity of steam distribution maximized. With widely spaced nozzles, the available energy exceeds the transport requirement. Although nozzle spacing can vary widely, from a practical point of view a maximum spacing could be about 400 feet, and a minimum spacing about 35 feet. The spacing is from about 100 to about 150 feet under most conditions. Injection tubing 120 can, if desired, be essentially centralized inside annulus 135 to provide a clearer path for steam flow around the entire circumference of the injection tubing. Desirably, nozzles 205 will be located near the center of annulus 135 between the outer surface 201 of the injection tubing and the inner surface 400 (see FIG. 4) of casing 116. Also desirably, the operation is carried out at an essentially constant temperature and pressure within the steam cavity formed by mobilizing hydrocarbons in formation 114. Minimizing any excess of flow-energy can be obtained by maintaining an essentially constant pressure, which also favors close spaced nozzles.

The maximum lift capacity can occur at the bottom of the horizontal portion of the well bore adjacent the closed end 300 (FIG. 3) of injection tubing 120. At that location, a 280 foot spacing of nozzles can provide an average of about 3 feet of lift per hundred foot of horizontal bore hole. This lift rate can vary from about 1.2 to about 4.8 per hundred feet over the life of the well. In the middle of the horizontal interval the lift capacity is less than half of the maximum, while the lift rate for the first nozzle below packer 126 is about 30% of the maximum. Selecting a spacing that provides the required lift for the upward undulations in the horizontal interval of the well bore can lessen the variation of pressure along the horizontal borehole.

The produced fluids rate at the earth's surface increases rapidly as the steam cavity expands upward to the top of formation 114. From that point it declines until the economic production rate limit is reached. The rate of liquid steam condensate production at the earth's surface is essentially the same as the steam injection rate at the earth's surface. Thus, for a typical design the steam injection rate at the earth's surface can start at about 12,000 pounds per hour, reach a peak of about 21,000 pounds per hour, and drop to about 11,000 pounds per hour as the economic production limit is reached.

Figure 4:
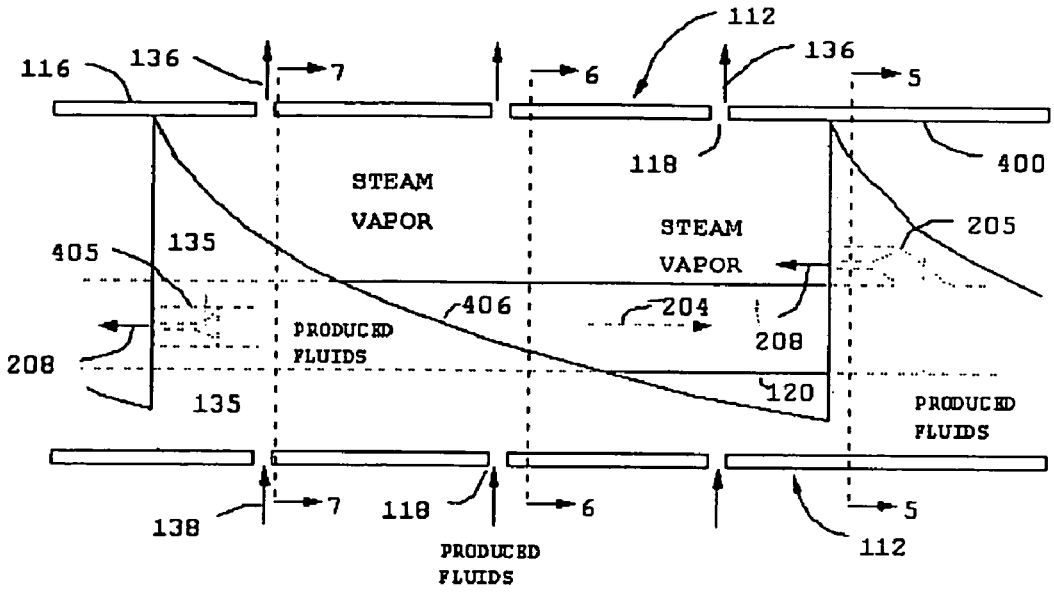
FIG. 4 shows a cross section of a portion of a well completion within this invention including a showing of how the vaporous steam injected by way of a jet nozzle interacts with produced fluids in the casing annulus surrounding the injection tubing.

FIG. 4 shows a cross-section of how produced fluids flow in the operation of this invention between adjacent jet nozzles 205 and 405, with nozzle 405 being located on the side of injection tubing 120, rotated about 90° from nozzle 205. Nozzle 205 is designed to introduce the steam vapor at the rate that will enter the steam cavity between nozzles 205 and 405. Line 406 shows the interface between essentially only vaporous steam, and essentially liquid produced fluids. Thus, immediately adjacent the outlet of nozzle 205 is primarily steam with a minor amount of liquid at the bottom of annulus 135. Intermediate nozzles 205 and 405, as steam escapes into formation 114 by way of holes 118 (arrows 136), the share (fraction) of liquid in annulus 135 increases. Just up stream of nozzle 405 the last of the steam vapor exits the annulus at that location. Thus it can be seen that steam 208 is a substantial propellant of liquid (produced fluids) that enters the annulus by way of holes 118 at the bottom of casing 116 as shown by arrow 138. Note that the produced fluids are also forcibly propelled in the direction of arrows 208 which is essentially parallel to long axis 200 (FIG. 3) and toward production inlet 127 (FIG. 1).

Figure 5:
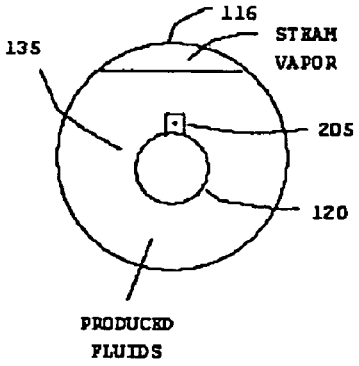
FIG. 5 shows a cross section 5-5 of FIG. 4, and further shows that annulus 135 is essentially 90% full of produced fluids at this location.

FIG. 5 shows a cross section 5-5 of FIG. 4, and further shows that annulus 135 is essentially 90% full of produced fluids at this location.

Figure 6:
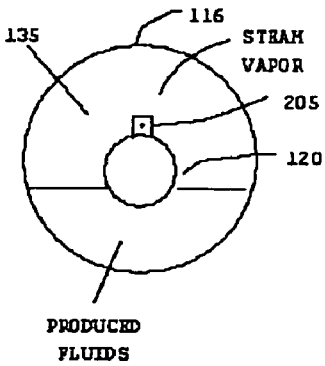
FIG. 6 shows a cross section 6-6 of FIG. 4, and further shows that annulus 135 is about 40% full of produced fluids at this location.

FIG. 6 shows a cross section 6-6 of FIG. 4, and further shows that annulus 135 is about 40% full of produced fluids at this location.

Figure 7:
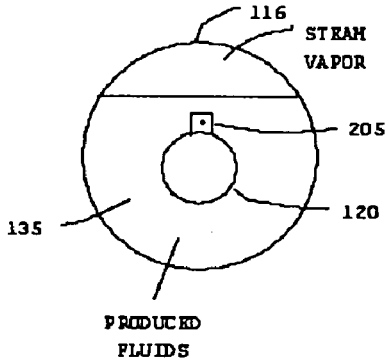
FIG. 7 shows a cross section 7-7 of FIG. 4, and further shows that annulus 135 is about 80% full of produced fluids at this location.

FIG. 7 shows a cross section 7-7 of FIG. 4, and further shows that annulus 135 is about 80% full of produced fluids at this location.

Thus, it can be seen that produced fluids are driven by steam 208 toward inlet 127, and, because of the flow-energy imparted by a plurality of spaced apart jet nozzles along the length of injection tubing 120, not only moves newly entering produced fluid, but, at the same time, moves trapped produced fluids from low spots such as area 141 (FIG. 1).

EXAMPLE

Formation 114 is at a depth of about 100 feet, and a thickness of about 36 feet. A well bore is drilled down to the formation and then horizontally in that formation for about 1,300 feet about 1 foot above the bottom of the formation. The well is cased with 9⅝ inch casing from the earth's surface to the beginning of the horizontal interval. The horizontal interval is cased with pre-perforated 7 inch outer diameter liner 116 (6.366 inch inner diameter). The 3½ inch outer diameter (2.992 inch inner diameter) production tubing string 124 extends from the earth's surface to and just through the dual packer 126, terminating at production inlet 127. Four inch outer diameter (3.548 inch inner diameter) steam injection tubing 120 extends essentially to the bottom of the well bore, i.e., far end of the horizontal section of the well bore and its casing (FIG. 1). Thirteen horizontally oriented (with respect to the long axes of both the casing and injection tubing) steam injection nozzles 205, 405, etc. are placed at about 100 foot intervals along and around (FIG. 3) the length of the injection tubing with their outlets facing toward inlet 127.

The horizontal section of the well bore and the steam cavity in formation 114 are kept at an essentially constant temperature and pressure of about 350° F. and about 135 psia.

The 13 nozzles use an initial steam injection rate of about 945 pounds per hour per nozzle, using nozzle chokes from about 0.302 to about 0.308 inches. Individual nozzle steam emission velocities are about 1,339 feet per second. The horizontal interval varies in a sinusoidal manner up and down from the intended well bore path about 1 foot.

After 3.5 years of production, the maximum steam injection rate is about 20.6 million BTU's per hour, thereby producing about 200 barrels of hydrocarbon per day and about 1,520 barrels of water per day. At this time each nozzle is emitting about 1,620 pounds of steam per hour at an exit velocity of about 1,384 feet per second.

At the multi-year producing life of the well, the injection rate is 11.1 million BTU's per hour of steam. The final producing rate is about 71 barrels of hydrocarbon per day and about 820 barrels of water per day. The final individual nozzle flow rate is about 865 pounds per hour with a steam emission velocity of about 1,334 feet per second.

I claim:

1. An apparatus for rendering mobile a viscous hydrocarbon carried in a subsurface geologic formation wherein an essentially horizontal well bore and perforated casing extend into said formation a finite length, said casing having an open interior and containing in an end of said interior a production tubing inlet, said casing also containing steam injection tubing extending into said casing interior, said injection tubing having an open interior for carrying steam therein, said injection tubing having an outer surface and a longitudinal axis that extends along a substantial portion of said casing length, the improvement comprising a plurality of spaced apart jet nozzles carried by said injection tubing on its outer surface, each said nozzles being oriented to emit vaporous steam from said injection tubing interior along said longitudinal axis of said injection tubing and toward said production tubing inlet.

2. The apparatus of claim 1 wherein said steam is initially emitted essentially parallel to said outer surface of said injection tubing.

3. The apparatus of claim 1 wherein from 8 to 15 nozzles are carried in a spaced apart fashion along said injection tubing, and are spaced apart from about 35 to about 400 feet from one another.

4. The apparatus of claim 1 wherein said nozzles are essentially equally spaced from one another along said longitudinal axis of said injection tubing.

5. The apparatus of claim 1 wherein said nozzles are carried on at least one of the top, side, and bottom of said injection tubing.

6. In a method for mobilizing a viscous hydrocarbon held immobile in a subsurface geologic formation wherein an essentially horizontal well bore and perforated casing are formed in at least a portion of said formation, said casing having an open interior volume and a production tubing inlet in said interior, said casing having in its interior essentially longitudinally co-extensive injection tubing, said injection tubing having an outer surface and containing a substantially smaller volume than said casing interior volume, and steam is injected from said injection tubing interior into said casing interior, the improvement comprising injecting said steam into said casing interior using a plurality of jet nozzles each having a constriction orifice, constricting the flow of said steam as it passes from said interior of said injection tubing into each said nozzle and then releasing said constricted steam from each said nozzle into said casing interior, and directing said steam emitted from each said nozzle along said outer surface of said injection tubing toward said production tubing inlet.

7. The method of claim 6 wherein said steam is initially emitted from said nozzles essentially parallel to said outer surface of said injection tubing.

8. The method of claim 6 wherein said steam is emitted from said nozzles at a velocity of from about 1,000 to about 1,400 feet per second.

9. The method of claim 6 wherein said nozzles have an essentially round constriction orifice that has a diameter of from about 7/32 to about 14/32 of an inch.

10. The method of claim 9 wherein said steam inside said injection tubing is at a pressure of from about 250 to about 680 psia, and a temperature of from about 400 to about 500° F.

11. The method of claim 6 wherein the volumetric ratio of said casing interior to said injection tubing interior is from about 3/1 to about 5/1.

* * * * *